US005762598A

United States Patent [19]

Spragg et al.

[11] Patent Number: 5,762,598

[45] Date of Patent: Jun. 9, 1998

[54] SIMULATION PROGRAM FOR CENTRIFUGATION USING A FIXED-ANGLE ROTOR

[75] Inventors: Peter Spragg, Warwickshire; David Rickwood, Essex; Steven Humphries, Norfolk, all of England; Mitsutoshi Yotsuyanagi, Yokohama; Kazuyoshi Tokunaga, Hitachinaka, both of Japan

[73] Assignee: Hitachi Koki Co., Ltd., Tokyo, Japan

[21] Appl. No.: 637,303

[22] Filed: Apr. 24, 1996

[30] Foreign Application Priority Data

Apr. 24, 1995 [JP] Japan ..... 7-098793

[51] Int. Cl.[6] ..... B04B 13/00

[52] U.S. Cl. ..... 494/37; 494/10

[58] Field of Search ..... 494/1, 7, 10, 11, 494/16, 20, 37, 85

[56] References Cited

U.S. PATENT DOCUMENTS 3,009,388 11/1961 Polanyi ..... 494/11 X
4,941,868 7/1990 Chulay et al. ..... 494/10 X
5,024,646 6/1991 Lewis et al. ..... 494/16
5,171,206 12/1992 Marque ..... 494/10 X
5,370,599 12/1994 Marque et al. ..... 494/10 X

OTHER PUBLICATIONS

"Centrifugation (2nd Edition), a practical approach", Edited by D. Rickwood.

*Primary Examiner*—Charles E. Cooley
*Attorney, Agent, or Firm*—Pollock, Vande Sande & Priddy

[57] ABSTRACT

A fixed-angle rotor, having a centrifuge tube inclined at a predetermined gradient angle with respect to a rotational axis, is used to obtain a sedimentation coefficient of sample particles. In one method, a distance in the centrifugal direction is corrected by the gradient angle θ of centrifuge tube 1. Sedimentation coefficient $S_{20,w}$ is calculated based on the corrected distance, and then the sedimentation coefficient $S_{20,w}$ is multiplied with sin(θ) to obtain a corrected sedimentation coefficient. In another method, a distance in the centrifugal direction is corrected by the gradient angle θ, and also an angular acceleration $\omega^2$ is corrected by dividing it by sin(θ). And then, the sedimentation coefficient $S_{20,w}$ is calculated based on thus corrected distance and corrected angular acceleration.

8 Claims, 5 Drawing Sheets

FIG. 6A
PRIOR ART
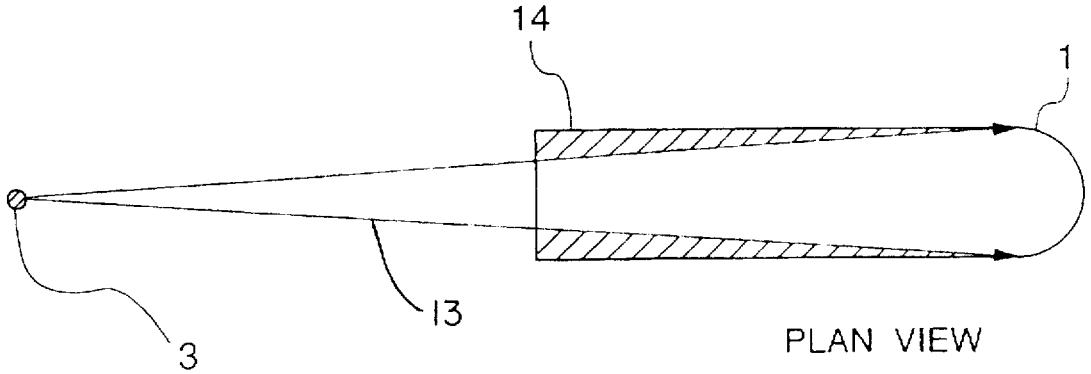
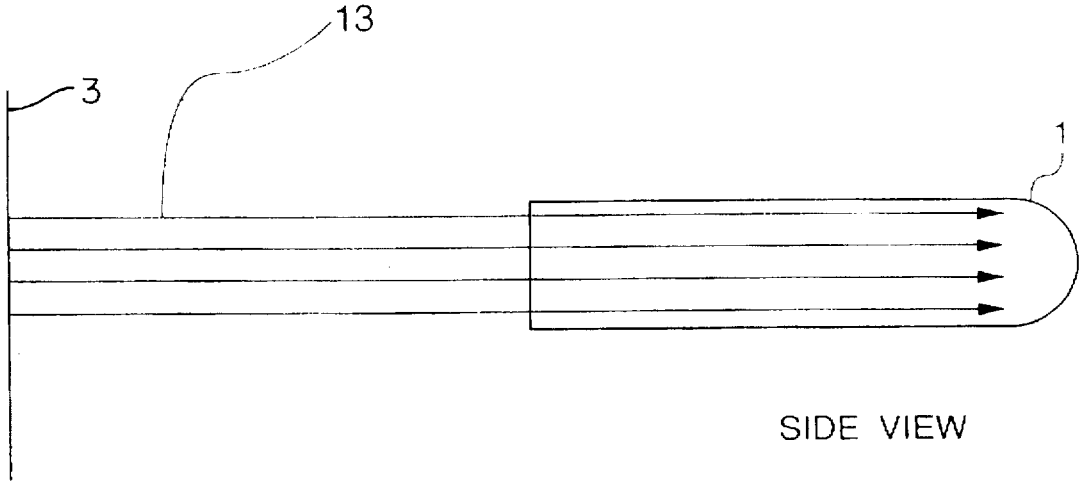
FIG. 6B
PRIOR ART

FIG. 7A
PRIOR ART
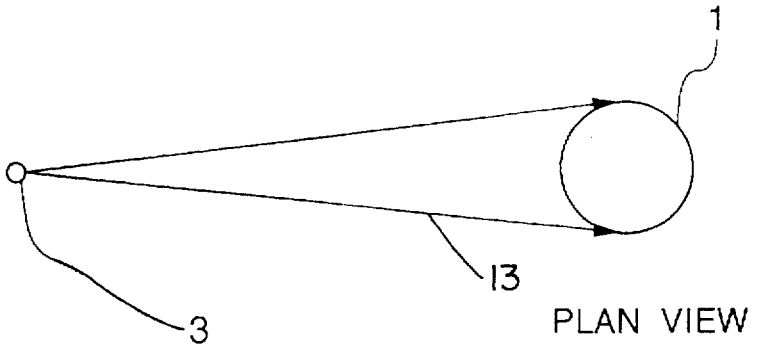
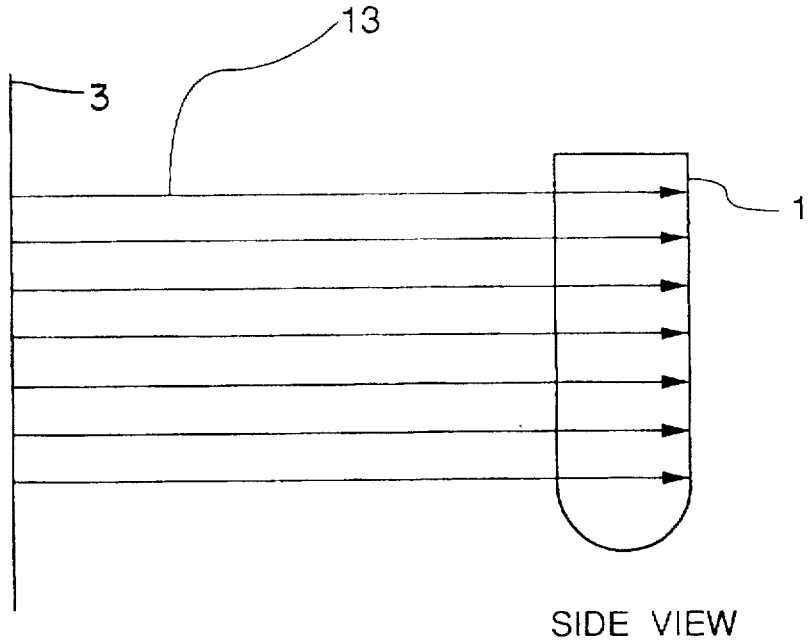
FIG. 7B

SIMULATION PROGRAM FOR CENTRIFUGATION USING A FIXED-ANGLE ROTOR

BACKGROUND OF THE INVENTION

1. Field of the Invention

The present invention generally relates to a simulation program for centrifugation, including the calculation and/or simulation related to the centrifugation and capable of calculating sedimentation coefficients of intended or concerned sample particles, and more particularly to a correcting method of coefficients in the simulation program using a fixed-angle rotor for centrifugation wherein the sedimentation coefficients of the objective sample particles are corrected by taking account of the gradient angle parameter of a centrifuge tube with respect to a rotational axis.

2. Prior Art

Among various methods using a centrifugal separator, a representative one is a rate-zonal separation, one of centrifugal separation methods, wherein a density-gradient substance, such as sucrose, is filled in a centrifuge tube to form separation layer(s) at the intermediate zone in the density gradient thus obtained. In general, this kind of rate-zonal separations are used not only for realizing a high accurate separation of sample particles but also for obtaining sedimentation coefficients of the sample particles.

The density gradient solution in the centrifuge tube, after being subjected to the centrifugal separation based on the rate-zonal separation, is collected or extracted successively by a predetermined amount from the upper part of the centrifuge tube, i.e. from the liquid surface of the density gradient solution, or from the bottom of the centrifuge tube, thereby dividing the density gradient solution into a plurality of test tubes. This dividing operation is generally referred to as "fractionation." Each divided solution is called "fraction."

Next, an amount of the sample involved in each fraction is quantitatively measured to identify which fraction involves the objective sample. A simple method for quantitatively measuring the amount of sample is to irradiate specific light having wavelength absorbed by the sample. As the specific light is irradiated, the absorbance is measured. When a certain fraction has a higher absorbance at the designated wavelength corresponding to the concerned sample, it means that this fraction involves the sample with a higher density.

The sedimentation coefficient of the sample particles is calculated in the following manner. Using the parameters of a rotor (vertical rotor or swing rotor) used in the centrifugation, the volume of each fraction is converted into a distance in the centrifugal direction of this rotor. A sediment speed of the sample particles is calculated based on the driving conditions of the centrifugal separator and the distance in the centrifugal direction. Then, a sedimentation coefficient is calculated as a parameter representing the magnitude of the sediment speed. In the field of application of centrifugal separators, thus calculated sedimentation coefficient is generally expressed as a value multiplied by 1×E13 (=$1\times10^{13}$). Hence, this embodiment uses the value already multiplied by 1×E13.

The sediment speed of the sample particles generally depends on the viscosity and density of the density gradient solution. Hence, the viscosity and density of the density gradient solution at an operation temperature are calculated based on the concentration of the density gradient solution. The sedimentation coefficient, corrected using thus calculated values, is comparable to the sedimentation coefficient ($S_{20,w}$) in the 20° C. water.

The sedimentation coefficient, $S_{20,w}$, is one of hydrodynamic parameters used to describe the sample particles. The method of calculating the above-described sedimentation coefficient is explained in greater detail in "Preparative centrifugation: A Practical Approach", IRL Press, Oxford, by David Rickwood, one of the inventors of the present invention.

The method of calculating the sedimentation coefficient in accordance with the rate-zonal separation is performed by the swing rotors having a centrifuge tube aligned in the direction (i.e. horizontal direction) parallel to a centrifugal force acting thereon during its centrifugal operation or by the vertical rotors having a centrifuge tube fixed in the vertical direction regardless of the generation of a centrifugal force acting in the direction normal to the axis of the centrifuge tube.

The above-described document "Preparative centrifugation: A Practical Approach" proposes a computation program applicable to both swing and vertical rotors which enables one to obtain a sedimentation coefficient on a personal computer in accordance with the rate-zonal separation.

The reason why these rotors, i.e. swing rotors and vertical rotors, are preferably used for the calculation of sedimentation coefficients of sample particles in accordance with the sediment speed method is that the separation layer is safely maintained without causing an adverse effect. More specifically, the separation layer is seldom disturbed by sample particles falling across the density gradient solution, since sample particles do not collide with the inside wall of a centrifuge tube.

FIGS. 6A and 6B in combination show a centrifuge tube in a swing rotor, wherein reference numeral 13 represents a sedimenting direction of sample particles. Of all the sample particles, only some existing in a shaded zone 14 have a possibility of colliding with the inside wall of the centrifuge tube when they are sedimenting across the density gradient solution. The ratio of such particles to all particles is very small and negligible, giving no substantial adverse effect on the overall sedimentation of all the sample particles.

Furthermore, FIGS. 7A and 7B show a centrifuge tube in a vertical rotor. In the vertical rotor, sample particles cause the sedimentation in the transverse direction of the centrifuge tube. Hence, the possibility that the sample particles collide with the inside wall of the centrifuge tube is zero before the sedimentation proceeds the mid point. It is, however, noted that, in the vertical rotor, there is the possibility that the separation layers may be disturbed due to reorientation, where the orientation of density gradient is turned 90 degrees before and after the centrifugation.

Fixed-angle rotors, well known and widely used as well as the above-described swing rotors and vertical rotors, differ from these swing rotors and vertical rotors in that the centrifuge tube 1 is fixed at a constant gradient θ with respect to a rotational axis 3. The fixed-angle rotors are generally superior to the swing rotors in that the centrifugation can be speedily and quickly performed, and are superior to the vertical rotors in that the reorientation can be suppressed small. However, it has been believed that the fixed-angle rotors are not preferable to use for the sediment speed method.

This is because the fixed-angle rotor is not free from a so-called wall effect, by which almost all of the sample particles sediment across the density gradient solution and collide with the inside wall of the centrifuge tube, and then continuously sediment along the inside wall of the centrifuge tube toward the bottom of the centrifuge tube. It was believed that such wall effect could disturb the separation layer.

Furthermore, fixedly supporting the centrifuge tube at a predetermined gradient angle with respect to the rotational axis will require a complicated conversion from a volume of each fraction to the distance in the centrifugal direction. The adverse effect of the wall effect to be given to the rate-zonal separation has been already confirmed in the ribonucleic acid base experiments (Anal. Biochem., 44,381) performed by Castaneda et al. in 1971.

The above-described "Preparative centrifugation: A Practical Approach" includes a report that the same phenomenon was confirmed in the experiments based on polysome, which is a structural substance in a cell.

From the reasons described above, there is no simulation program for centrifugation applicable to the fixed-angle rotors in the calculation of a sedimentation coefficient in accordance with the rate-zonal separation.

SUMMARY OF THE INVENTION

Accordingly, in view of above-described problems encountered in the prior art, a principal object of the present invention is to provide a novel and excellent simulation program for centrifugation enabling the use of fixed-angle rotors for the calculation of a sedimentation coefficient in accordance with the rate-zonal separation.

In order to accomplish this and other related objects, one aspect of the present invention provides a method for simulating centrifugation using a fixed-angle rotor which has a centrifuge tube inclined at a predetermined gradient angle with respect to a rotational axis, comprising steps of: calculating a sedimentation coefficient of sample particles; and correcting the sedimentation coefficient based on the gradient angle of the centrifuge tube.

According to features of preferred embodiments of the present invention, a distance in the centrifugal direction is corrected by the gradient angle of the centrifuge tube, and the sedimentation coefficient is calculated based on the corrected distance, and then the sedimentation coefficient is multiplied with a sine of the gradient angle of the centrifuge tube, thereby correcting the sedimentation coefficient of the sample particles.

According to other features of the preferred embodiments of the present invention, a distance in the centrifugal direction is corrected by the gradient angle of the centrifuge tube, and an angular acceleration is corrected by the gradient angle of the centrifuge tube, and then the sedimentation coefficient of the sample particles is calculated based on the corrected distance and the corrected angular acceleration. In this case, it is preferable that the angular acceleration is divided by a sine of the gradient angle of the centrifuge tube to correct the angular acceleration.

BRIEF DESCRIPTION OF THE DRAWINGS

The above and other objects, features and advantages of the present invention will become more apparent from the following detailed description which is to be read in conjunction with the accompanying drawings, in which:

FIGS. 6A and 6B are views illustrating sedimentation of sample particles in a swing rotor during its centrifugation operation; and FIGS. 7A and 7B are views illustrating sedimentation of sample particles in a vertical rotor during its centrifugation operation.

DETAILED DESCRIPTION OF THE PREFERRED EMBODIMENTS

Figure 1:
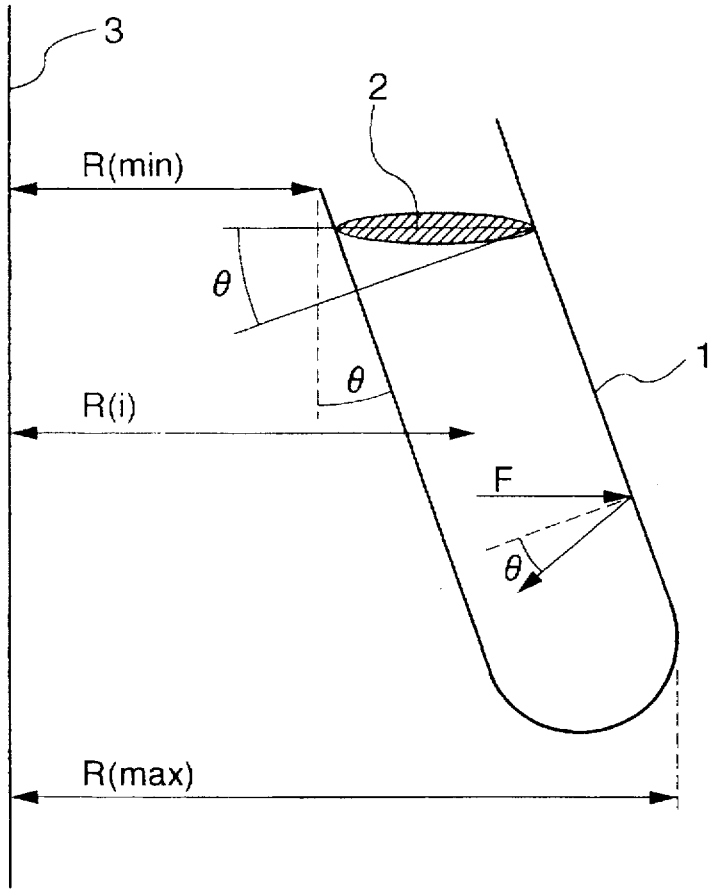
FIG. 1 is a schematic view showing an arrangement of a centrifuge tube with respect to a rotational axis in a fixed-angle rotor.

Preferred embodiments of the present invention will be explained in greater detail hereinafter, with reference to the accompanying drawings. Identical parts are denoted by an identical reference numeral throughout views.

FIG. 1 is a schematic view showing an arrangement of a centrifuge tube 1 with respect to a rotational axis 3 in a fixed-angle rotor. A shaded portion 2 represents a transverse cross section transversely crossing a density gradient solution filled in the centrifuge tube 1, which is parallel to the liquid surface of the density gradient solution when the rotor is stopped. The centrifuge tube 1 is fixed to the rotational axis 3 at a predetermined gradient angle θ. The transverse cross section 2 is inclined at the gradient angle θ with respect to the direction normal to the wall surface of the centrifuge tube 1.

The rate-zonal separation is carried out in the following manner. A density gradient solution is provided in the centrifuge tube 1. Then, a layer of sample particles suspended in a liquid having a smaller density than that of the density gradient solution is formed on the liquid surface of thus provided density gradient solution. Subsequently, the centrifuge tube 1 is sealed and set in position in the rotor, and is then rotated about rotational axis 3.

In general, after finishing the centrifugation operation, the density gradient solution in the centrifuge tube 1 is divided into a series of fractions each having a small volume. To this end, the centrifuge tube 1 is stationarily placed keeping its vertical position or attitude after being taken out from the rotor.

To calculate the sedimentation coefficient of sample particles, it is necessary to calculate a distance of sedimentation caused by the sample particles under affection of a centrifugal force F during a predetermined centrifugal time at a position in the rotational radius direction.

A shifting distance of the sample particles in a centrifugation using a fixed-angle rotor is not so easy to obtain compared with that in a swing rotor. More specifically, in the centrifugation using a swing rotor, the shifting distance of the sample particles can be easily obtained based on the height of a fraction in the centrifuge tube which involves the sample particles and the minimum rotational radius of the centrifuge tube. On the other hand, when the fixed-angle rotor is used, the measurement of the shifting distance definitely requires the data to be corrected based on the gradient of the centrifuge tube 1 during the centrifugal operation.

The transverse cross-sectional area in the solution, denoted by reference numeral 2, is always normal to a force acting thereon. Namely, when the rotor is stopped stationarily, the transverse cross-sectional area is an ellipse extending in the horizontal direction. On the other hand, when the rotor is rotated, the transverse cross-sectional area 2 turns its face 90 degrees due to the centrifugal force, causing a reorientation. Hence, when the sample particles are sedimenting, the shape of the transverse cross-sectional area 2 is an ellipse standing vertically. However, when the centrifuge tube 1 is stationarily positioned so as to extend in the vertical direction after finishing the centrifugation, the transverse cross-sectional area 2 becomes a circle. In response to these changes, the area of the transverse cross-sectional area 2 is varied.

In view of these facts, the distance from a rotational axis to the tail end of an i-th fraction in the radial direction during the centrifugation can be corrected using the following equation 1.

$$R(i) = R(min) + R(t)/\cos(\theta) + \sin(\theta) \times \cos(\theta) \times \sum_{n=1}^{i} V(n,s)/(\pi \times R(t)^2) \quad (1)$$

where R(i) represents a distance from the rotational axis to an i-th fraction (cm); R(min) represents a distance from the rotational axis to the liquid surface in the centrifuge tube (cm); R(t) represents an inner radius of the centrifuge tube (cm); θ represents a gradient angle of the centrifuge tube in the rotor (°); and V(n,s) represents a volume of an n-th fraction ($cm^3$).

In this embodiment, the sedimentation coefficient is calculated based on the distance R(i) defined by the above-described equation (1), density and viscosity in the density gradient solution, and operational conditions of the centrifugal separator.

However, in the fixed-angle rotor, sample particles cause the sedimentation across the density gradient solution in the direction of centrifugal force F. As can be understood from FIG. 1, such sedimentation causes collision between sample particles and the inside wall of centrifuge tube 1.

The fact confirmed through experiments is that the sample particles having molecular weight smaller than 500,000 dalton (atomic mass unit) surely cause an elastic collision with the inside wall of centrifuge tube 1 where the sample particles are reflected from the inside wall at a reflection angle equal to the gradient angle θ of the centrifuge tube 1.

From this fact, it is believed that the sample particles will sediment toward the bottom of centrifuge tube 1 at a speed faster than the predicted speed based on the sedimentation coefficient inherent to the sample particles. Hence, in the calculation of the sedimentation coefficient of this concerned sample particle, it becomes necessary to correct the sedimentation speed considering the fact that the sedimentation is more quickly performed than expected. Such correction can be attained by calculating the sedimentation coefficient $S_{20,w}$ using a value equivalent to the angular acceleration divided by a sine of the reflection angle of the sample particles, i.e. sin (θ).

The angular acceleration is expressed by $\omega^2$, where ω represents the angular speed defined by the following equation (2).

$$\omega = \frac{2 \cdot \pi \cdot N}{60} \quad (2)$$

where N represents the rotational speed of the rotor (rpm).

The above-described "Preparative centrifugation: A Practical Approach" discloses the method for calculating the sedimentation coefficient $S_{20,w}$ based on the sedimentation distance of sample particles and the angular acceleration, applicable to the swing rotors and/or vertical rotors.

Hence, in the same manner as the method disclosed in "Preparative centrifugation: A Practical Approach", the sedimentation coefficient $S_{20,w}$ applicable to the fixed-angle rotor can be calculated by using the sedimentation distance corrected by the previously explained method, i.e. the distance of each fraction in the centrifugal direction, and the angular acceleration corrected by the previously explained method.

Figure 4:
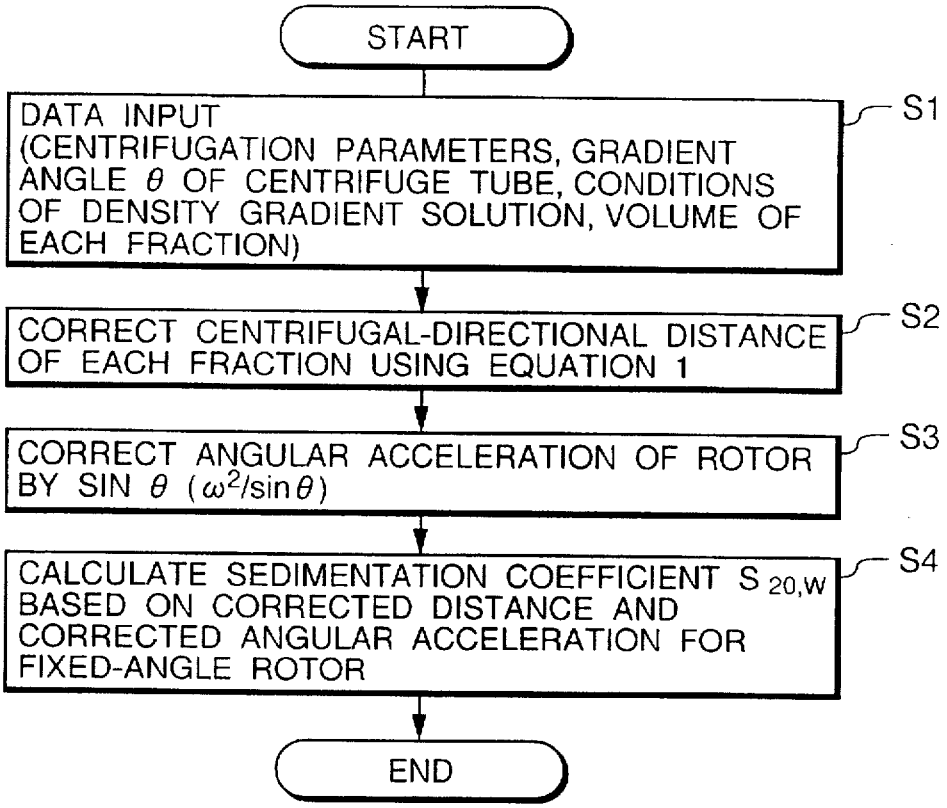
FIG. 4 is a flow chart showing a calculation procedure in accordance with one embodiment of the present invention.

FIG. 4 is a flow chart showing details of the calculation procedure for obtaining the sedimentation coefficient $S_{20,w}$ applicable to the fixed-angle rotor.

First, various data are input in step S1. Various data, entered in this step, comprises centrifugation parameters, gradient angle θ of the centrifugal tube, conditions of the density gradient solution, and a volume of each fraction.

Next, in step S2, the distance of each fraction in the centrifugal direction is corrected by using equation 1.

Then, in step S3, the angular acceleration ($\omega^2$) of the rotor is corrected by dividing it by sin(θ). In other words, the corrected angular acceleration is defined by $\omega^2/\sin(\theta)$.

Subsequently, in step S4, the sedimentation coefficient $S_{20,w}$ for the fixed-angle rotor is calculated based on the distance corrected in step S2 and the angular acceleration corrected in step S3.

The following equation (3) represents a generic equation for obtaining the sedimentation coefficient.

$$S = \frac{1}{\omega^2 r} \times \frac{dr}{dt} \quad (3)$$

where S represents the sedimentation coefficient of the concerned sample particle, while "r" represents a distance from the rotational axis to the concerned sample particle at time t.

Meanwhile, in considering the above-described following equation (3) calculating the sedimentation coefficient, it will become apparent that the correction can be performed in the same manner by multiplying sin(θ) with the sedimentation coefficient calculated in the previously explained method.

That is, the sedimentation coefficient $S_{20,w}$ for the fixed-angle rotor can be calculated based on the sedimentation distance corrected by the previously explained method in substantially the same manner as in the method shown in FIG. 4 by multiplying sin(θ) with the sedimentation coefficient $S_{20,w}$ to be obtained according to the method described in the "Preparative centrifugation: A Practical Approach".

Figure 5:
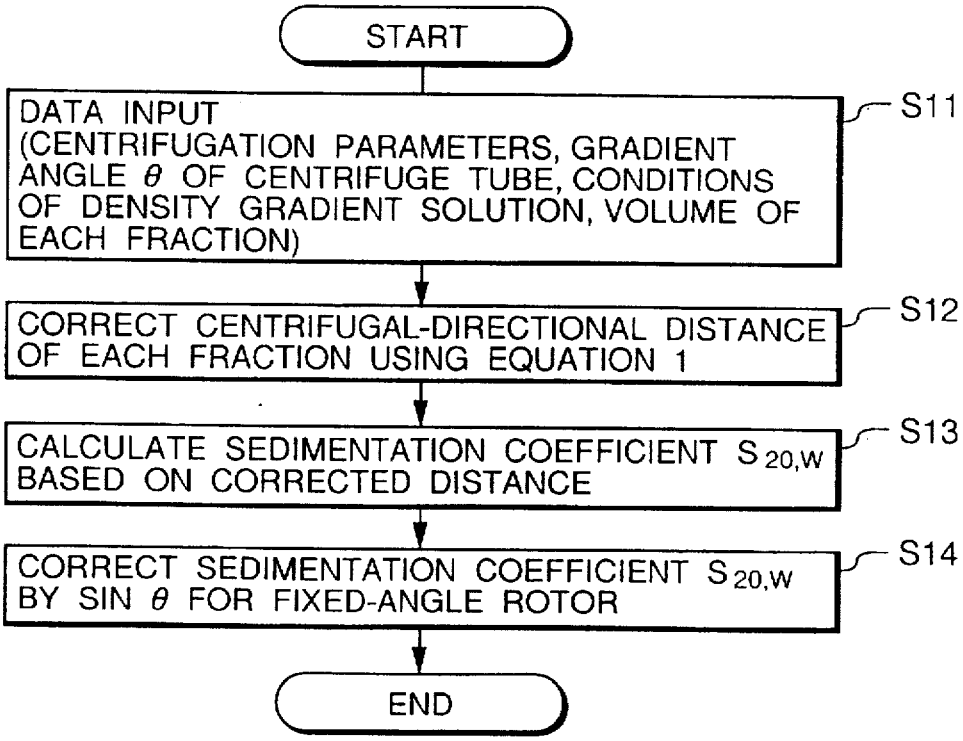
FIG. 5 is a flow chart showing a calculation procedure in accordance with another embodiment of the present invention.

FIG. 5 is a flow chart showing details of the calculation procedure for obtaining the sedimentation coefficient $S_{20,w}$ applicable to the fixed-angle rotor in accordance with this latter method.

First, various data are input in step S11. Various data, entered in this step, comprises centrifugation parameters, gradient angle θ of the centrifugal tube, conditions of the density gradient solution, and a volume of each fraction.

Next, in step S12, the distance of each fraction in the centrifugal direction is corrected by using equation 1.

Then, in step S13, the sedimentation coefficient $S_{20,w}$ is calculated based on the distance corrected in step S12.

Subsequently, in step S14, the sedimentation coefficient $S_{20,w}$ is corrected by multiplying it with sin(θ).

This latter method is more practical than the former one, because computations can be greatly simplified.

Figure 2:
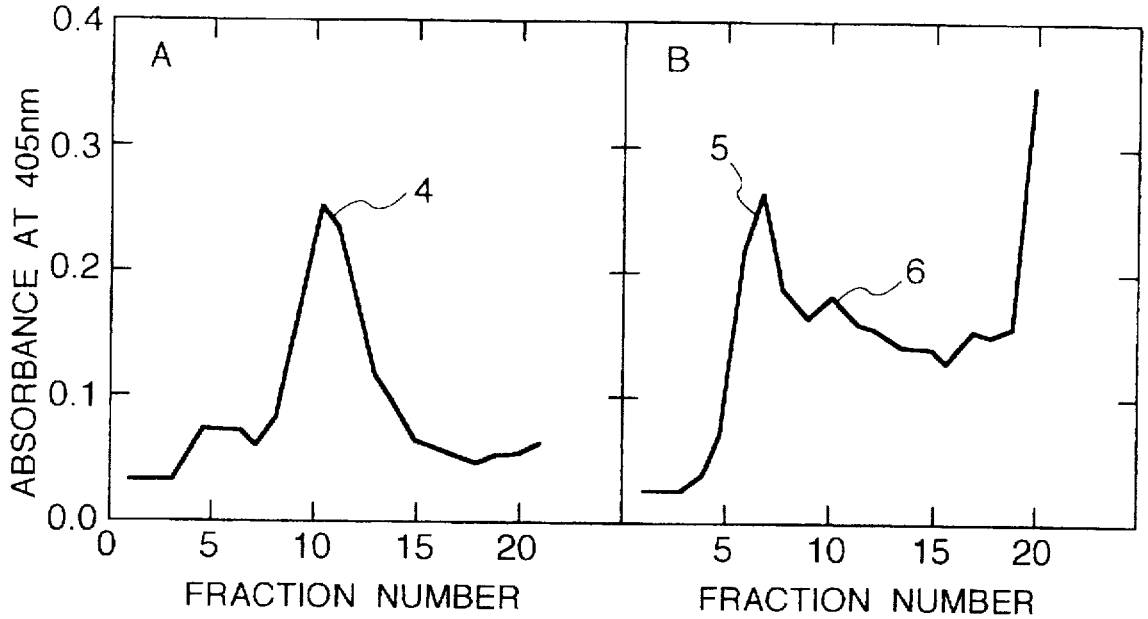
FIG. 2 is a graph showing experimental results in accordance with the rate-zonal separation using a fixed-angle rotor.

Hereinafter, the effect of the above-described embodiments of the present invention will be explained based on the practical experimental data. FIG. 2 shows experimental results obtained through the rate-zonal separation using a fixed-angle rotor.

The fixed-angle rotor, used in the experiments, comprises a centrifuge tube having 13 ml in volume and being set at 20° in gradient angle. In these experiments, 10–40% linear sucrose gradient solution is used for the density gradient solution across which the sample particles cause sedimentation. The sample particles used in the experiments are catalaze monomer (molecular weight 240,000) and its polymer.

After finishing the centrifugal operation, the density gradient solution is divided into fractions each having a volume of 0.5 ml. To express a relative content of the sample, absorbance is measured at the wavelength 405 nm which is one of wavelengths absorbed by protein.

In FIG. 2, the ordinate represents the absorbance at the wavelength 405 nm, while the abscissa represents the serial number of fractions. The smaller the serial number, the higher the fraction is positioned in the density gradient solution. The fraction, denoted by the smallest serial number, is positioned most closely to the liquid surface of the density gradient solution.

The left part of FIG. 2 shows the experimental result obtained through a four-hour centrifugal operation using catalaze monomer only. The right part of FIG. 2 shows the experimental result obtained through a 2.5-hour centrifugal operation using both catalaze monomer and catalze polymer.

In the left part of FIG. 2, a peak 4 explicitly shows the presence of a specific fraction involving the separation layer of catalaze, i.e. sample particles. In the right part of FIG. 2, peaks 5 and 6 indicate the presence of fractions involving catalaze monomer and catalaze dimer, respectively.

Table 1 shows the experimental data of the tested fixed-angle rotor in relation to the sedimentation coefficient corrected in accordance with the correcting method of the present invention. In the table 1, $S_{20,w}$ represents the sedimentation coefficient which is not corrected yet, while $S_{20,w}\times\sin(\theta)$ represents the sedimentation coefficient having been corrected.

TABLE 1

| | ROTOR SPEED (RPM) | OPERATION TIME (H) | PEAK POSITION (MM) | $S_{20,w}$ | $S_{20,w}\cdot SIN(8)$ |
|---|---|---|---|---|---|
| EXPERIMENT 1 | 65,000 | 2.0 | 59.7 | 31.3 | 10.7 |
| MONOMER | | | | | |
| EXPERIMENT 2 | | | | | |
| MONOMER | 52,000 | 2.5 | 54.4 | 27.2 | 9.3 |
| DIMER | | | 59.7 | 37.4 | 13.1 |

From the experiment 1 using catalaze monomer only, it was verified that the sedimentation coefficient 10.7S was obtained as a result of correction in accordance with the present invention. This value is apparently different from the value 11.2S or 11.4S which is a well-known sedimentation coefficient (as later shown in Table 2). From the experiment 2, it was also verified that the sedimentation coefficients of the catalaze monomer and catalaze dimer involved in the mixture were 9.3S and 13.1S, respectively.

Figure 3:
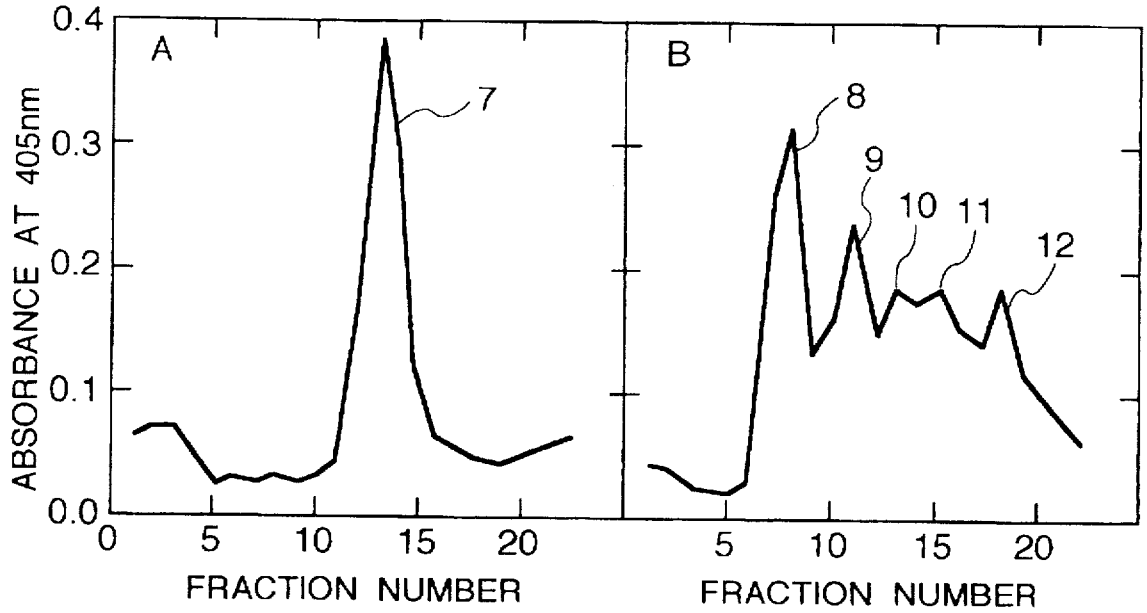
FIG. 3 is a graph showing experimental results in accordance with the rate-zonal separation using a swing rotor.

For the purpose of comparison between a fixed-angle rotor and another type rotor, FIG. 3 shows experimental results obtained through the rate-zonal separation using a swing rotor. The left part of FIG. 3 shows the experimental result obtained through a 22-hour centrifugal operation using catalaze monomer only. The right part of FIG. 3 shows the experimental result obtained through a 13-hour centrifugal operation using both catalaze monomer and catalze polymer.

In the left part of FIG. 3, a peak 7 explicitly shows the presence of a specific fraction involving the separation layer of catalaze, i.e. sample particles. In the right part of FIG. 3, peaks 8 through 12 indicate the presence of fractions involving catalaze monomer through catalaze pentamer, respectively.

Table 2 shows the experimental data of the tested swing rotor in relation to sedimentation coefficient $S_{20,w}$.

TABLE 2

| | ROTOR SPEED (RPM) | OPERATION TIME (H) | PEAK POSITION (MM) | $S_{20,w}$ |
|---|---|---|---|---|
| EXPERIMENT 1 | 40,000 | 22 | 97.4 | 11.2 |
| MONOMER | | | | |
| EXPERIMENT 2 | | | | |
| MONOMER | 40,000 | 11 | 90.2 | 11.4 |
| DIMER | | | 99.8 | 18.0 |

From the experiment 1 using catalaze monomer only, it was confirmed that the sedimentation coefficient was 11.2S. From the experiment 2 using a mixture of catalaze monomer and dimer, it was confirmed that sedimentation coefficients of catalaze monomer and catalaze dimer were 11.4S and 18.0S respectively.

According to the experiment of the fixed-angle rotor, $S_{20,w}$ of catalaze monomer was 10.7S. This value is smaller than $S_{20,w}$ obtained in the experiment of the swing rotor by an amount of 0.7S. This difference is practically allowable, and is within an allowable extraction error in the fractionation. However, the difference is so large in the catalaze dimer that it greatly exceeds the allowable extraction error. From this fact, it is believed that catalaze dimer is not so elastic as catalaze monomer. In other words, it is evident that the elasticity of a sample particle is decreased with increasing size of the particle. Catalaze of $S_{20,w}$=11 is a relatively large protein having molecular weight 240,000. It is, therefore, believed that many of sample particles, smaller than 11 in the sedimentation coefficient $S_{20,w}$, can be properly separated by the rate-zonal separation.

As apparent from the foregoing description, when the sample particles less than 11 in the sedimentation coefficient $S_{20,w}$ are separated using a fixed angle rotor, it is possible to determine the sedimentation coefficient of the sample particles by obtaining $S_{20,w}$ based on the distance in the centrifugal direction corrected using the gradient of the centrifuge tube, and then correcting thus obtained $S_{20,w}$ by a sine of the gradient of the centrifuge tube.

As this invention may be embodied in several forms without departing from the spirit of essential characteristics thereof, the present embodiments described are therefore intended to be only illustrative and not restrictive, since the scope of the invention is defined by the appended claims rather than by the description preceding them, and all changes that fall within metes and bounds of the claims, or equivalents of such metes and bounds, are therefore intended to be embraced by the claims.

What is claimed is:

1. A method for simulating centrifugation using a fixed-angle rotor which has a centrifuge tube inclined at a predetermined gradient angle with respect to a rotational axis of said rotor, comprising steps of:

calculating a sedimentation coefficient of sample particles under a rate-zonal separation in said centrifuge tube; and correcting said sedimentation coefficient based on the gradient angle of said centrifuge tube.

2. A method for simulating centrifugation using a fixed-angle rotor which has a centrifuge tube inclined at a predetermined gradient angle with respect to a rotational axis of said rotor, comprising the steps of:

calculating a sedimentation coefficient of sample particles under a rate-zonal separation in said centrifuge tube; and correcting said sedimentation coefficient based on the gradient angle of said centrifuge tube, wherein a distance in a direction of a centrifugal force acting on said centrifuge tube is corrected by said gradient angle of said centrifuge tube, and said sedimentation coefficient is calculated based on said corrected distance, and then the sedimentation coefficient is multiplied with a sine of said gradient angle of the centrifuge tube, thereby correcting the sedimentation coefficient of the sample particles.

3. A method for simulating centrifugation using a fixed-angle rotor which has a centrifuge tube inclined at a predetermined gradient angle with respect to a rotational axis of said rotor, comprising the steps of:

calculating a sedimentation coefficient of sample particles under a rate-zonal separation in said centrifuge tube; and correcting said sedimentation coefficient based on the gradient angle of said centrifuge tube, wherein a distance in a direction of a centrifugal force acting on said centrifuge tube is corrected by said gradient angle of said centrifuge tube, and an angular acceleration of said centrifuge tube is corrected by said gradient angle of said centrifuge tube, and then said sedimentation coefficient of the sample particles is calculated based on said corrected distance and said corrected angular acceleration.

4. The simulation method in accordance with claim 3, wherein said angular acceleration is divided by a sine of said gradient angle of the centrifuge tube, thereby correcting said angular acceleration.

5. A method for simulating centrifugation using a fixed-angle rotor which has a centrifuge tube inclined at a predetermined gradient angle with respect to a rotational axis of said rotor, comprising the steps of:

calculating a sedimentation coefficient of sample particles suspended in a density gradient solution in said centrifuge tube, said sedimentation coefficient being calculated based on a viscosity and a density of said density gradient solution; and correcting said sedimentation coefficient based on the gradient angle of said centrifuge tube.

6. The simulation method in accordance with claim 5, wherein a distance in a direction of a centrifugal force acting on said centrifuge tube is corrected by said gradient angle of said centrifuge tube, and said sedimentation coefficient is calculated based on said corrected distance, and then the sedimentation coefficient is multiplied with a sine of said gradient angle of the centrifuge tube, thereby correcting the sedimentation coefficient of the sample particles.

7. The simulation method in accordance with claim 5, wherein a distance in a direction of a centrifugal force acting on said centrifuge tube is corrected by said gradient angle of said centrifuge tube, and an angular acceleration of said centrifuge tube is corrected by said gradient angle of said centrifuge tube, and then said sedimentation coefficient of the sample particles is calculated based on said corrected distance and said corrected angular acceleration.

8. The simulation method in accordance with claim 5, wherein said angular acceleration is divided by a sine of said gradient angle of the centrifuge tube, thereby correcting said angular acceleration.

* * * * *